United States Patent [19]

Midttun

[11] Patent Number: 4,900,280

[45] Date of Patent: Feb. 13, 1990

[54] APPARATUS FOR DETECTING THE PITCH OF A MARINE CONTROLLABLE PITCH PROPELLER

[76] Inventor: Ole H. Midttun, 56 Lewis Ave., Walpole, Mass. 02081

[21] Appl. No.: 232,793

[22] Filed: Aug. 16, 1988

[51] Int. Cl.[4] ..... B63H 3/00

[52] U.S. Cl. ..... 440/50; 416/61

[58] Field of Search ..... 440/50, 2; 416/49, 61, 416/163; 415/118

[56] References Cited

U.S. PATENT DOCUMENTS

| | | | |
|---|---|---|---|
| 2,321,025 | 6/1943 | Hammond, Jr. | 440/50 |
| 3,589,830 | 6/1971 | Mogren et al. | 416/27 |
| 3,895,883 | 7/1975 | Pedersen | 416/61 |

OTHER PUBLICATIONS

Brochure of Bird-Johnson Company, "Controllable Pitch Propeller".

Brochure of RDL (Renou-Dardel) for controllable pitch propellers.

Brochure of KaMeWa/Seffle, "Controllable Pitch Propellers & Valment Reduction Gear Boxes".

*Primary Examiner*—Joseph F. Peters, Jr.

*Assistant Examiner*—Jesûs D. Sotelo

*Attorney, Agent, or Firm*—Herbert L. Gatewood

[57] ABSTRACT

The pitch setting of a machine controllable pitch propeller is indicated with a high accuracy by comparing the positions of the portions within the vessel hull of a translating member fastened to the pitch change mechanism within the propeller hub and a non-translating member fastened adjacent one end to the hub and extending essentially free of axial load through the propeller shaft into the vessel hull.

1 Claim, 1 Drawing Sheet

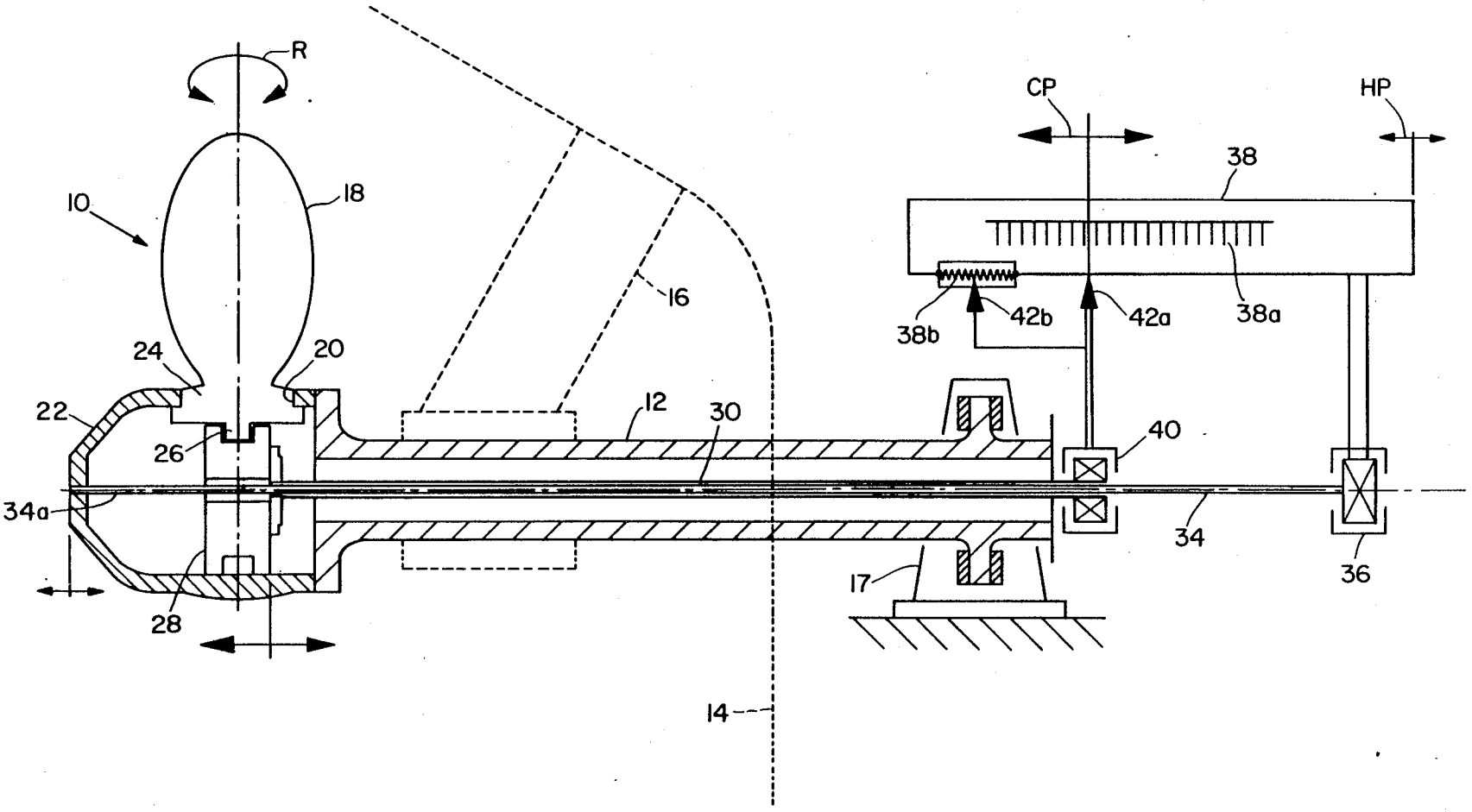
HP
CP
38
38a
38b
42a
42b
36
34
40
17
14
30
12
16
18
20
R
10
24
26
22
34a
28

APPARATUS FOR DETECTING THE PITCH OF A MARINE CONTROLLABLE PITCH PROPELLER

BACKGROUND OF THE INVENTION

For optimum performance and efficiency of a marine controllable pitch propeller ("CCP") it is necessary to control the pitch as accurately as possible. For pitch readout, most control systems for CPP's rely on the physical fore-and-aft position of a part of a translating member of the pitch control mechanism that is within the vessel hull.

Various designs of commonly used CPP's exist. For example, one design employed by manufacturers of CPP's for many years consists of a hub and blade assembly in which the pitch is controlled by a hydraulic piston and crosshead assembly in the hub. The piston drives a crosshead in a fore-and-aft direction which, in turn, pivots the blades by rotating the blade mounts through an arc by means of an eccentric pin/sliding block/slot arrangement or, in a variation of this design, by means of a system of mechanical links connecting the crosshead and blade mounts. The piston movement is controlled by a directional actuating valve, the valve body of which is affixed to the piston-crosshead assembly and the spool of which is affixed to the aft end of an oil transmitting tube (referred to herein as "valve rod") that extends forward within the propeller shaft into the hull of the vessel and to a device referred to herein as "oil distribution box" or "O.D. box." The oil distribution box includes rotary seals and oil passages for transmitting the hydraulic actuating oil to and from the hydraulic piston in the hub through the rotating propeller shaft and the rotating/translating valve rod.

Located in the oil distribution box is an actuating device that moves the valve rod, and hence the valve spool, fore and aft in response to control signals from the remote control apparatus of the CPP system. The directional actuating valve directs hydraulic actuating oil to the selected side of the piston, and the piston-crosshead assembly translates in the desired direction to effect a pitch change of the blades. When the valve rod has been moved by the actuating device in the O.D. box to a position such as to establish the desired propeller pitch, the movement of the valve rod is stopped. The piston-crosshead assembly continues moving a small distance until the valve spool is centered in the valve body, at which point the flow of oil to the piston and movement of the piston/crosshead assembly are stopped.

The valve rod translates with the piston and crosshead assembly. The fore-and aft position of the inboard end of the valve rod provides, therefore, an indication of the position of the piston-crosshead assembly in the hub and thereby of the pitch of the blades. Pitch indication is provided in most systems by means of a pointer attached to the forward end of the valve rod and a pitch scale attached to the oil distribution box. In addition most systems have a device for generating a pneumatic or electrical signal used for remote indication of the pitch-setting and as a feedback signal for processing in the control system to maintain a desired pitch. This remote feedback indication and signal is provided by means of pneumatic or electrical signals generated by detecting the position of an inboard portion of the valve rod.

The oil distribution box can be located either in the shaft line or forward of the reduction gear box at the forward end of the shaftline. The pitch-indicating scale and the stationary parts of the remote-signalling device are usually affixed to the oil distribution box and, in effect, also affixed to the hull (via the shaftline and thrust bearing for O.D. boxes located in the shaftline and via the reduction gear casing for O.D. boxes located on the reduction gear casing). The thrust bearing is in the shaftline and is, therefore, located aft of the O.D. box for O.D. boxes mounted on the reduction gear box at the forward end of the shaftline and can be located either forward or aft of the O.D. box for shaft-mounted O.D. boxes. The pointer of the pitch-indicating scale is affixed to the valve rod, and the movable parts of the remote-signalling device are coupled to the valve rod. The propeller is, of course, located outboard at the aft end of the propeller shaft. In some ships the distance between the pitch-indicating scale and remote-signalling device and the propeller is more than 300 feet.

Inaccuracies in the pitch-indication system result from the fact that both the valve rod and the propeller shaft are subject to changes in length due to changes in propeller load, hydraulic oil pressure, and oil, sea, and air temperatures. With installations where the O.D. box is located on the reduction gear casing, additional inaccuracies result from the displacement of the propeller/-valve rod/hub assembly with respect to the pitch scale and remote-signalling device due to thrust bearing manufacturing clearances and normally permitted thrust bearing wear-down limits. Inaccuracies due to changes in shaft and valve rod length caused by steady-state loads and thrust bearing wear-down are predicable and can, to some extent, be compensated for in the designs of the scale and the remote-signalling and processing system. However, inaccuracies due to temperature changes and to transient load changes, such as those associated with vessel speed changes in magnitude and-/or direction, cannot be readily designed into the scale or readily compensated for in the control system logic.

Changes in temperature are not easily dealt with. One can imagine sensing the water temperature as indicative of the actual shaft and valve rod temperatures and repositioning the scale (or pointer) to adjust for changes in length due to such temperature changes. Such an approach, however, is complicated and only partly solves the problem, because the lengths of the shaft and the valve rod are affected by temperature conditions other than the water temperature, such as the temperature of the oil supplied to the hub servo as well as the ambient air temperature around the part of the shaft within the hull.

The actual pitch-setting of the propeller is represented accurately by the fore-and-aft position of the aft end of the valve rod relative to the propeller hub (except for a small and normally acceptable inaccuracy due to variations in valve spool centering location). The inaccuracies in propeller pitch indicated by the scale and signalled by the remote-signalling device result from the variations described above in the lengths of the shaft and the valve rod between the hub and the components of the scale and the remote-signalling device.

In accuracies in indicated and detected pitch similar to those described above are present in other types of CPP systems. In CPP systems in which the actuating valve for the hydraulic piston in the hub is within the vessel (either inside or outside the shaft), the translatable oil supply tube and propeller shaft, with which the pitch-indicating and pitch-detecting devices are associated, are subject to the variations in length described above. So also are the pitch-indicating and pitch detecting devices of force-rod type CPP systems subject to inaccuracies resulting from changes in the lengths of the shaft and force rod due to load and temperature variations that are not easily compensated for.

In summary the conditions that affect the inaccuracy of inboard pitch indication by detection of the position of an inboard part of a valve rod, oil supply tube or force rod relative to a scale affixed, in effect, to the hull vary considerably, and monitoring such conditions and compensating for them in the pitch detection and control system would introduce complications, increase costs and be only partly successful in eliminating inaccuracies.

As used hereinafter the term "non-translating member" refers to a tube or rod that is affixed at its outboard end to the propeller hub or to shafting closely adjacent the hub and is substantially unrestrained at the inboard end. Also, as used hereinafter, the term "translating member" refers to a tube or rod which translates fore-and-aft with blade pitch-angle rotation, normally by means of being connected to the translating crosshead in the hub. In the three most commonly used CPP system types, as previously described, the term "translating member" refers to a valve rod, a translating oil supply tube, a force rod or a separate rod or tube connected to the crosshead or piston but otherwise substantially unrestrained axially. The term "non-translating member" refers to a separate rod or tube coupled to the hub (or to the shafting closely adjacent the hub) or a non-translating oil supply tube.

SUMMARY OF THE INVENTION

The present invention is based on detecting the difference in displacements between two members, one member being a translating member (affixed to and translating fore and aft with the pitch mechanism in the hub) and the other being a non-translating member (affixed to the hub or adjacent parts).

There is provided, in accordance with the present invention, an improved apparatus for use in CPP systems to detect the propeller pitch comprising a non-translating member that is affixed to the propeller hub (or shaft system near the hub) and extends essentially free of axial loads through the shaft and into the vessel hull, a translating member that is affixed in the hub to a moving crosshead or other part of the pitch change mechanism and extends essentially free of axial loads through the shaft and into the vessel hull, a device for detecting the fore-and-aft position of an inboard portion of the non-translating member, a device for detecting the fore and aft position of an inboard portion of the translating member, and a device for comparing the detected positons of respective inboard portions of the non-translating member and the translating member.

The propeller hub, non-translating member and translating member are equally displaced fore-and-aft due to thrust bearing wear-down and clearance and changes in shaft length due to temperature and load changes. Both the translating member and the non-translating member are located within the propeller shaft and are, therefore, subject to similar conditions that affect their temperatures, and they will similarly expand and contract in amounts proportional to their actual temperature and coefficient of thermal expansion in response to temperature changes. The fore-and-aft position of the inboard end of the translating member corresponds to the crosshead position relative to the hub. The fore-and-aft position of the inboard end of the non-translating member corresponds to the position of the hub. The translating member's movement relative to the hub due to pitch setting is independent of movements of the translating and non-translating member due to the above-mentioned thrust bearing effects and shaft length changes. Accordingly, the position of the inboard portion of the translating member relative to the position of the inboard portion of the non-translating member reasonably accurately reflects the position of the crosshead relative to the hub and thereby the propeller pitch.

In some military vessels, it is common to provide propeller blades with an air emission capability with air normally being provided to the propeller by means of a separate air tube located in the shaft bore and being affixed to the hub at its outboard end. The air supply tube of the air emission system can also serve as the non-translating member in the present invention and thereby eliminate the need to provide a separate non-translating member in such ships.

For a better understanding of the invention reference may be made to the following description of an embodiment, taken in conjunction with the accompanying drawing.

DESCRIPTION OF THE DRAWING

The drawing is a schematic diagram of an embodiment of the invention.

DESCRIPTION OF AN EMBODIMENT

A hub and blade assembly 10 of a CPP system is affixed to the aft end of a propeller shaft 12. The dashed lines represent the ship's hull 14 and a support 16 carrying the aftmost shaft bearing. The shaft 12 extends into the hull and imparts thrust to the vessel by engagement with a thrust-bearing assembly 17. The propeller blades 18 (there are normally two or more propeller blades, but only one is shown) are mounted in ports 20 in the hub 22 on crank rings 24 (with which they may be integral or to which they may be bolted). An eccentric crankpin 26 on the crank ring is coupled by a slide block (not shown) to a crosshead 28 that is movable fore-and-aft in the hub. Fore-and-aft movement of the crosshead 28 rotates the blades in their mounts (arrow R) to change the propeller pitch. The crosshead is caused to move by a drive device, usually a hydraulic piston (not shown) which is normally located either in the propeller hub or inside the ship.

Regardless of the type of drive device used to move the crosshead 28, a translating member 30 in the form of a rod or tube extends forward from the crosshead in the hub through the shaft 12 into the hull.

In CPP systems in which the drive device for the crosshead is a piston located in the hub and in which a directional actuating valve is also located in the hub, the translating member 30 is a tubular valve rod. The valve spool is affixed to the aft end of the valve rod, and a suitable hydraulic fluid under pressure, such as oil, is supplied through the valve rod from an O.D. box to one or the other side of the piston under the control of the valve to move the crosshead to a position in the hub establishing the desired blade pitch. The hydraulic fluid from the non-working side of the piston is returned to the O.D. box and thence to a reservoir through the annulus between the valve rod and the shaft 12. When the valve spool is centered in the valve body, the valve is fully closed, and the desired pitch is held by the oil trapped in the piston chamber. The position of the valve rod (translating member 30) is indicative of the pitch of the propeller.

In CPP systems having a piston in the hub and a control valve within the ship's hull, an oil supply pipe that translates with the piston serves as the translating member 30. The translating member 30 in a force-rod actuated CPP system is either the force rod by which the crosshead is positioned mechanically or a separate rod or tube connected to the crosshead. In all cases, the translating member 30 extends forward from the crosshead 28 within the propeller shaft to a location within the hull 14. The devices associated with a particular form of translating member (e.g., O.D. boxes, valve-positioning devices, actuating servo pistons, control valves and the like) are well known to those skilled in the art and are not, therefore, described or shown.

A non-translating member 34 is affixed at its aft end 34a to the propeller hub 22, runs forwardly through the shaft 12, and is coupled at its forward end to a position detector 36, which may, for example, be a bearing having an inner race that rotates with the non-translating member 34 and a non-rotating outer race coupled to an output element 38. The non-translating member is axially unrestrained along its length so that all points along it are indicative of the position of the propeller hub. The output element 38, as shown schematically, may be a visually readable scale **38*a* or the windings of an electrical potentiometer 38*b***. Equivalent output elements include pneumatic and hydraulic servo control valves and various types of optical, electrical (including digital) and magnetic position detectors. More generally, the arrow HP (hub position) represents an output signal indicative of the position of a portion of the non-translating member within the vessel hull and, therefore, of the position of the propeller hub.

An especially convenient application of the present invention is offered by the existing air tube of a CPP system equipped with an air emission system, inasmuch as the air tube may serve as the non-translating member 34.

A portion of the translating member 30 within the vessel hull is also provided with a suitable position detector 40 with a bearing being shown schematically as an example. The output of the position detector 40 is represented by the pointer **42*a* associated with the scale 38*a* and the movable contact 42*b* associated with the windings of the potentiometer 38*b*. More generally, the arrow CP (crosshead position) represents an output signal indicative of the position of a portion of the translating member 30** located within the vessel hull and, therefore, of the position of the crosshead.

Pitch indication is provided by comparing the signals CP and HP. In the examples depicted schematically in the drawing, comparisons are made mechanically by the positions of the pointer **42*a* and the scale 38*a* and electromechanically by the positions of the contact 42*b* and winding 38*b*** of the potentiometer. Equivalent comparisons of HP and CP can be made by various mechanical, electrical, optical, magnetic, pneumatic and hydraulic devices that provide various forms of outputs, including pitch feedback signals for processing by the control system and local and remote pitch indications.

I claim:

1. In a marine controllable pitch propeller system that includes a hub and blade assembly having a plurality of blades mounted on a hub to pivot about axes disposed generally radially of the propeller shaft axis, means including a translating member extending from the hub through the shaft and into the hull of the vessel for changing the pitch settings of the blades in response to and correspondence with fore-and-aft movements of the translating member, and means for detecting the pitch setting of the propeller by monitoring the fore-and-aft position of a portion of the translating member within the vessel hull, the improvement wherein the pitch-detecting means comprises a non-translating member affixed adjacent one end to the hub and extending essentially free of axial loads through the shaft into the vessel hull, means for detecting the fore-and-aft position of an inboard portion of the non-translating member, means for detecting the fore-and-aft position of an inboard portion of the translating member, and means for comparing the respective positions of said inboard portion of the translating member with the position of said inboard portion of the non-translating member and producing an output representing such comparison.

* * * * *